United States Patent [19]

Yarris

[11] 4,124,104

[45] Nov. 7, 1978

[54] LIFT MASK CARRIAGE MOUNTING ARRANGEMENT

[75] Inventor: William T. Yarris, Brookpark, Ohio

[73] Assignee: Towmotor Corporation, Mentor, Ohio

[21] Appl. No.: 798,057

[22] Filed: May 18, 1977

Related U.S. Application Data

[63] Continuation of Ser. No. 676,833, Apr. 14, 1976, abandoned.

[51] Int. Cl.[2] ..... B66B 9/20

[52] U.S. Cl. ..... 187/95; 187/9 E

[58] Field of Search ..... 187/9 R, 9 E, 11, 95, 187/1 R; 308/6 R

[56] References Cited

U.S. PATENT DOCUMENTS

| | | | |
|---|---|---|---|
| 2,759,562 | 8/1956 | Ulinski | 187/9 E |
| 3,213,967 | 10/1965 | Hastings et al. | 187/9 E |
| 3,433,325 | 3/1969 | McIntosh | 187/95 |
| 3,556,247 | 1/1971 | Shinoda et al. | 187/9 E |
| 3,768,595 | 10/1973 | Kelly, Jr. | 187/9 E |
| 3,851,732 | 12/1974 | Wagner et al. | 187/9 E |

*Primary Examiner*—Robert W. Saifer

*Assistant Examiner*—Jeffrey V. Nase

*Attorney, Agent, or Firm*—Charles E. Lanchantin, Jr.

[57] ABSTRACT

A lift mask carriage mounting arrangement is disclosed including a support assembly having an upright pair of laterally spaced and inwardly facing channular beams forming rail surfaces and interconnecting web surfaces at substantially right angles thereto, and a carriage assembly having an upright pair of elongated legs disposed between the channular beams for movement longitudinally along them, an upper pair of guide rollers and a lower pair of guide rollers mounted on the legs for in use rolling engagement with the rail surfaces of their respectively associated channular beams in planes substantially perpendicular thereto, and a pair of canted guide rollers mounted on the legs elevationally intermediate the upper and lower guide rollers for in use rolling engagement with the rail surfaces and with the web surfaces of their respectively associated channular beams in planes angularly related to the perpendicular planes of the upper and lower guide rollers for cornerringly transmitting loads from the carriage assembly to the channular beams. Preferably, a side thrust roller is mounted on each of the legs elevationally between the upper and canted guide rollers.

3 Claims, 5 Drawing Figures

LIFT MASK CARRIAGE MOUNTING ARRANGEMENT

This is a continuation of Ser. No. 676,833 filed Apr. 14, 1976, now abandoned.

BACKGROUND OF THE INVENTION

In the usual fork-type lift truck, the forks are raised by a vertically extensible lift mast arrangement located at the forward end of the truck. The forks are placed beneath a load, are initially raised a limited amount for transportation purposes, and are thereafter raised to a desired elevation for depositing the load on a stack, shelf or the like. Such a mast arrangement usually includes a rearwardly disposed support assembly having at least one pair of upright channular beams, a forwardly disposed carriage assembly mounted by a plurality of rollers for rolling engagement longitudinally within the beams, and a motor or lifting device to cause relative vertical dispacement therebetween. Exemplifying the prior art in this area are the following U.S. Pat. Nos.:

2,759,562 issued to B. I. Ulinski on Aug. 21, 1956.

3,213,967 issued to R. Hastings, Jr et al. on Oct. 26, 1965.

3,556,247 issued to A. Shinoda et al. on Jan. 19, 1971.

3,768,595 issued to W. H. Kelley, Jr. on Oct. 30, 1973.

For the most part, the aforementioned lift mast constructions have experienced distortion of the channular beams due to the loading of the rollers under typically adverse circumstances and severe flaking of the beams by the rollers after extended service due to high contact stresses. A considerable portion of these problems is caused by offset loads on the forks which tends to cock or rotate the carriage assembly relative to the channular beams which guides it. To solve this, many arrangements of rollers have been adopted, including the addition of side thrust rollers which serve to transmit lateral forces and to relieve the longitudinally oriented rollers of this function. Upper and lower pairs of guide rollers, as well as another intermediately elevational spaced pair of guide rollers are being used with separate side thrust rollers disposed in various locations in the limited space often found in these lift masts.

More recently, canted rollers have been commercially introduced on lift mast carriage arrangements whereby the upper rollers are canted to contact the inside corner angles adjacent the front rail surfaces and webs of the channular beams and the lower rollers are oppositely canted to contact the corner angles adjacent the rear surfaces of the channular beams. In this way it is possible to omit one or two pairs of side thrust rollers in certain lift masts. However, the roller engaging surfaces of the beams then experience a reduced wear life because the canted guide rollers do not transmit direct in-line forces. Moreover, the service life of the canted guide rollers is reduced over straight guide rollers because more side thrust is absorbed thereby.

It is to be appreciated that it is difficult to accurately and positively adjust the position of the usual longitudinally oriented rollers and the position of the side thrust rollers in order to distribute the loads evenly and to stabilize the carriage assembly as it is positioned in the channular beams. Moreover, this adjustment problem becomes more complex when canted guide rollers are used, and the accurate shimming and manufacturing thereof is considerably more expensive to undertake.

Still another major factor relates to the advantages associated with a six roller carriage assembly, wherein the carriage assembly can advantageously be elevated beyond that of a four roller assembly because the upper pair of rollers are allowed to travel upwardly beyond the extremities of the channular beams. This complicates the roller arrangement at the upper portion of the carriage assembly since both longitudinal and transverse guiding must still be retained.

Another factor involves the tendency of certain side thrust roller arrangements to laterally spread the beams, so that it is further considered to be desirable to transmit offset loads on the carriage assembly solely into one of the beams.

SUMMARY AND OBJECTS OF THE INVENTION

Accordingly, an object of the invention is to provide an improved lift mast carriage mounting arrangement having a plurality of rollers thereon which are so positioned and arranged as to more effectively transfer both longitudinal and transverse forces on the carriage assembly into the guiding channular beams.

Another object of the invention is to provide such a roller and carriage mounting arrangement which will better resist distortion of the channular beams by transferring offset loads on the carriage assembly to a single one of the beams.

Another object of the invention is to provide a carriage mounting arrangement of the aforementioned type which will have a limited number of guide rollers and a minimum of close tolerance adjustment thereof.

Another object of the invention is to extend the service life of the guide rollers.

Another object of the invention is to minimize wear and/or flaking problems on the rolling surfaces of the channular beams.

Another object of the invention is to provide a carriage mounting arrangement of the character set forth wherein an elevationally intermediate pair of rollers are so positioned and oriented on the carriage assembly as to favorably transfer longitudinal and transverse forces to the guiding channular beams when the carriage assembly is raised to extend the upper rollers beyond the channular beams.

Other objects and advantages of the present invention will become more readily apparent upon reference to the accompanying drawings and the following description.

DESCRIPTION OF THE PREFERRED EMBODIMENT

Figure 1:
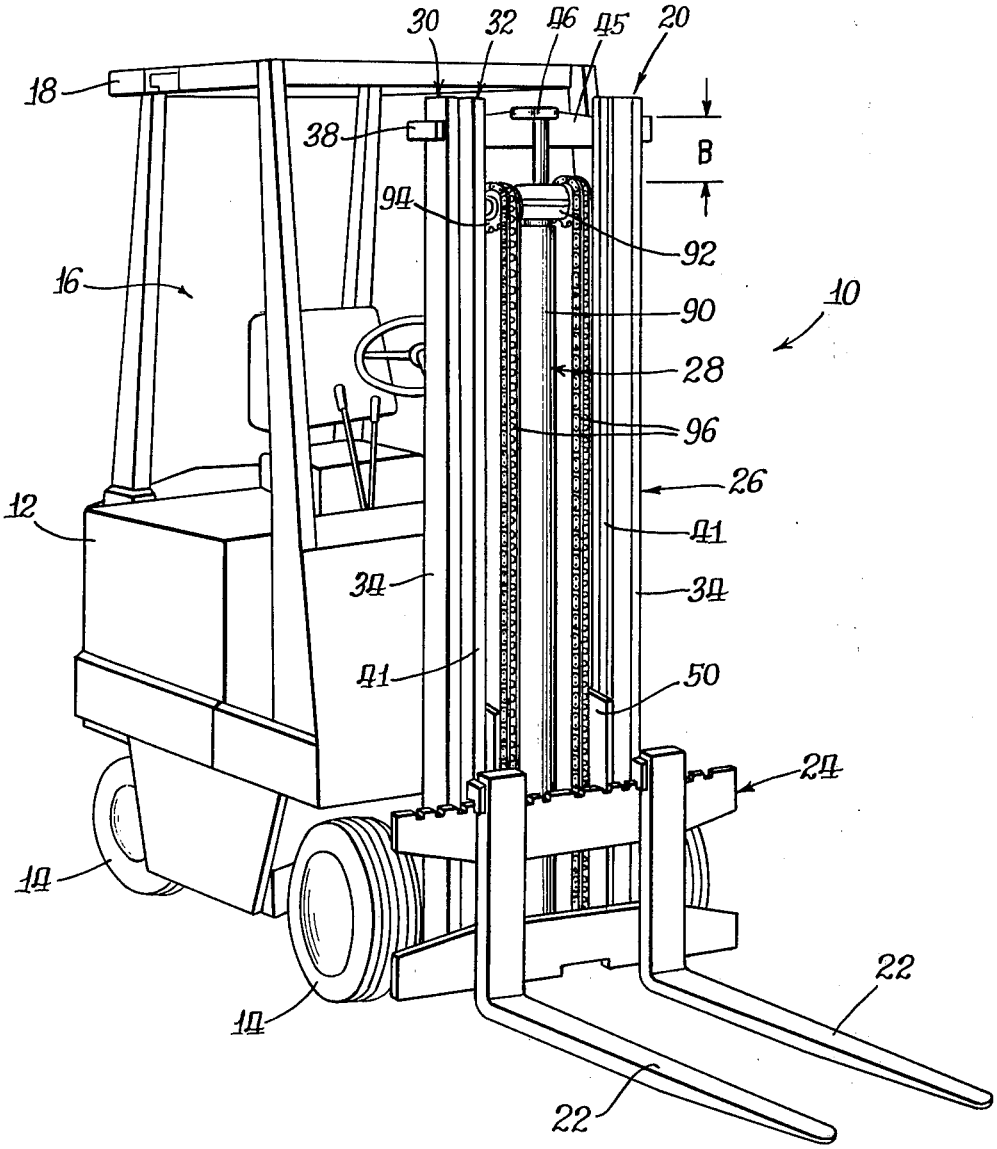
FIG. 1 is a perspective view of a fork-type lift truck incorporating the lift mast carriage mounting arrangement of the present invention.

Referring initially to FIG. 1, a fork-type lift truck 10 is shown as having a body portion 12 mounted on driving and steerable wheels 14, and an operator's station 16 bounded by a protection canopy 18. A lift mast carriage mounting arrangement 20 constructed in accordance with the present invention is mounted on the front of the lift truck body portion, and is so arranged as to allow vertical lowering and raising of a pair of load-carrying forks 22.

Basically, the lift mast carriage mounting arrangement 20 includes a front carriage assembly 24, a rearwardly disposed support assembly 26, and an extendable lifting apparatus 28 operationally connected therebetween. Preferably, the support assembly consists of two major components, namely, a rear stationary upright 30 which is appropriately secured to the body portion 12, and an inner upright 32 nested for vertical rolling movement within it.

Figure 3:
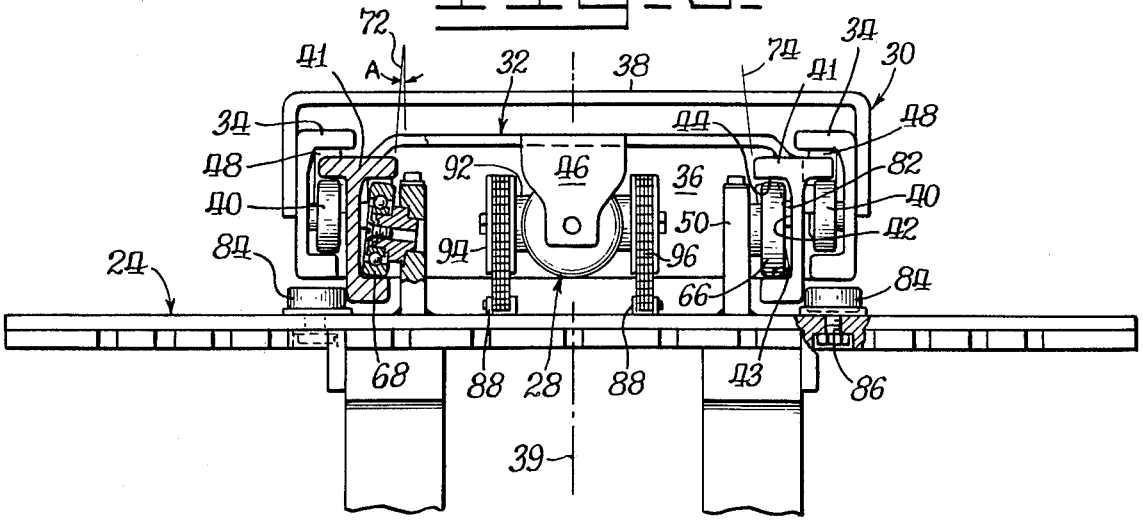
FIG. 3 is a fragmentary top plan view of the lift mast carriage mounting arrangement of FIG. 1 with portions broken away to better illustrate details of operation thereof.

More specifically, and as best shown in FIGS. 1 and 3, the rear stationary upright 30 includes an upright pair of laterally inwardly facing C-shaped channels 34 which are integrally secured to a sturdy base 36, and at least one laterally connecting tie bar 38 secured to the channels at the upper ends thereof. The tie bar is positioned for maximum operator visibility and maintains the channels in parallel relation. In addition, a pair of longitudinally oriented guide rollers 40 are mounted on the laterally inner face of each of the channels at the upper extremity thereof. In this connection, the term "longitudinally oriented" and similar phrases hereinafter used relates to those elements which are arranged in planes parallel to an upright and centrally disposed longitudinal plane 39.

Figure 2:
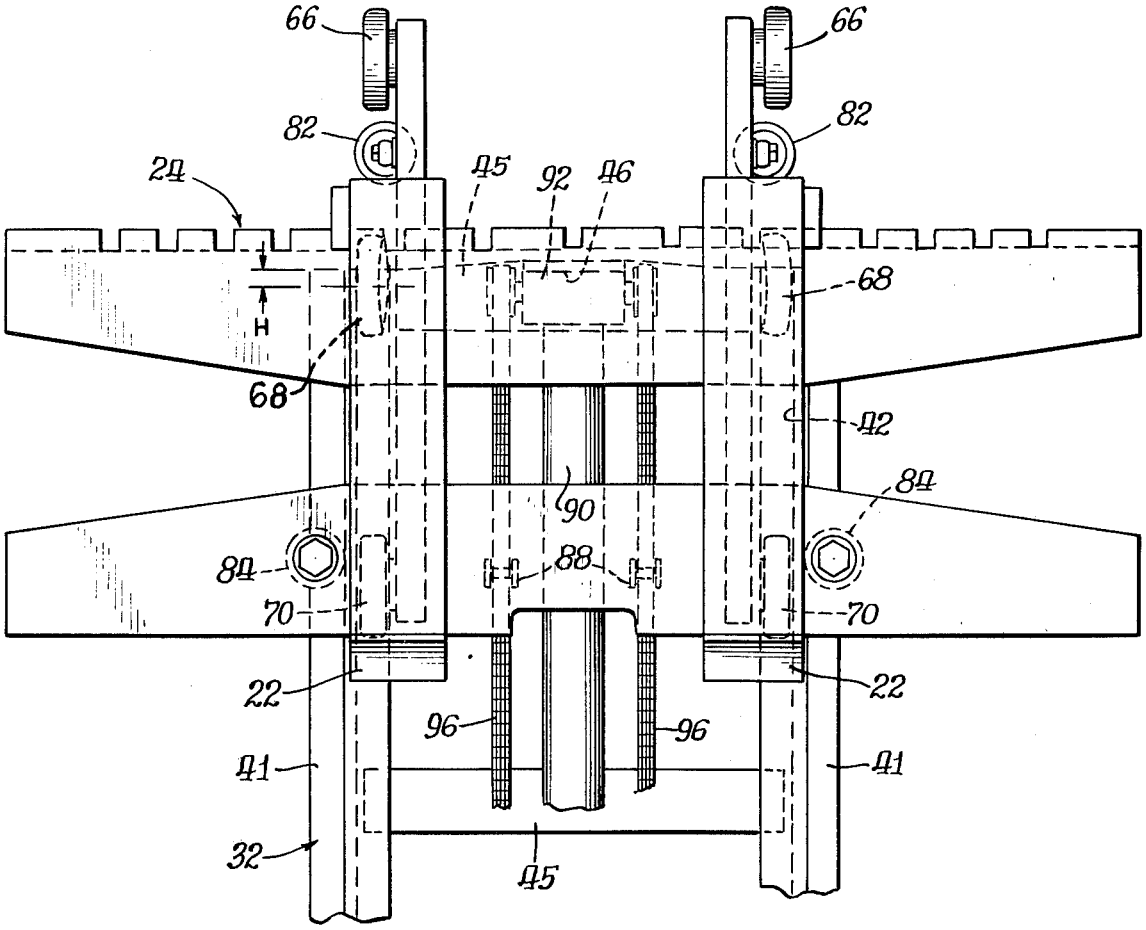
FIG. 2 is a front elevational view of the upper portion of the lift mast carriage mounting arrangement of FIG. 1 only showing the carriage assembly raised to its maximum elevated position.

With reference now to the construction of the inner upright 32 illustrated in FIGS. 1, 2 and 3, it is clearly seen to include an upright pair of inwardly facing J-shaped channular beams 41. These beams are preferably of hot rolled alloy steel to resist deflection, and which also provide good wear resistance. Each of these beams has a laterally inwardly disposed and longitudinally oriented roller-engaging web surface 42, and a front rail surface 43 and a rear rail surface 44 substantially normal thereto bordering the ends thereof and forming internal corners therewith. In order to provide a rigid frame-like inner upright structure, at least two vertically spaced apart and distortion resistant support bars 45 extend transversely between the rear portions of the beams. These support bars are also positioned for maximum visibility and maintain the beams in parallel. Moreover, a cantilevered arm 46 extends horizontally and forwardly at the top of the upper support bar for operational cooperation with the lifting apparatus 28, and at the lower extremity of each of the beams a longitudinally oriented guide roller 48 extends outwardly and longitudinally rearwardly to engage the C-shaped channels 34 of the stationary upright 30. While the lower guide rollers 48 are partially obscured by the upper rollers 40 in FIG. 3, it is nevertheless apparent that both sets cooperate to allow the inner upright to be moved vertically and closely laterally within the stationary channels in the usual manner.

Figure 4:
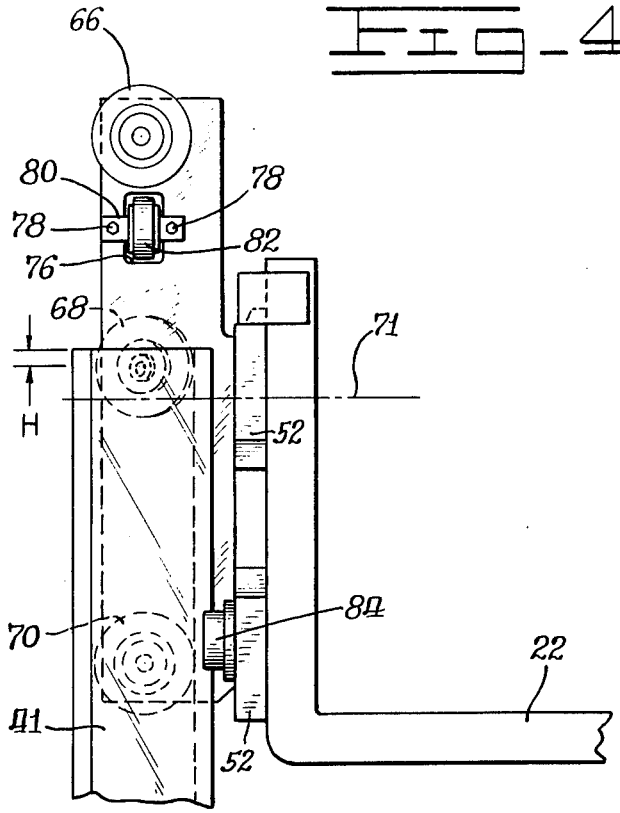
FIG. 4 is a fragmentary right side elevational view of the diagrammatically simplified lift mast carriage mounting arrangement of FIG. 2.
Figure 5:
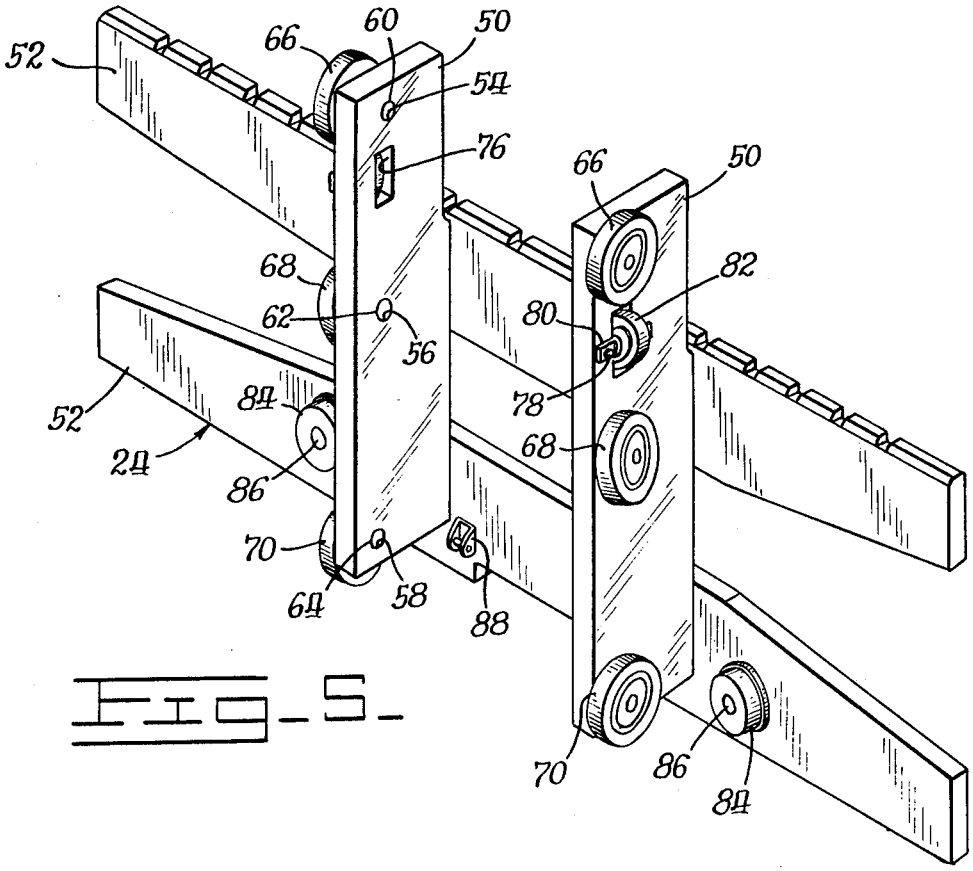
FIG. 5 is a rear oblique elevational perspective view of the carriage assembly shown in FIGS. 1 through 4.

In accordance with the present invention, and as clearly illustrated in FIGS. 4 and 5, the carriage assembly 24 includes an upright pair of elongated legs 50 which are weldably secured in laterally spaced relation to a pair of vertically separated and transversely elongated steel back-up plates 52. The legs are also steel plates which are longitudinally oriented in the normal travel direction of the lift truck 10 and are disposed in symmetrical facing relation. Each of the legs has an upper pin bore 54, a central pin bore 56 and a lower pin bore 58 formed therein which are adapted to respectively receive a stepped pin 60, a stepped pin 62 and a stepped pin 64. These pins are cylindrically stepped and extend laterally outwardly from the legs to serve as support mounts for an upper pair of guide rollers 66, an intermediate pair of canted guide rollers 68, and a lower pair of guide rollers 70, respectively. Preferably, the intermediate guide rollers are disposed above a horizontally oriented mid-plane 71 spaced elevationally equidistantly from the upper and lower pairs of guide rollers.

In keeping with one of the principle features of the invention the upper guide rollers 66 and lower guide rollers 70 are longitudinally oriented, while the intermediate guide rollers 68 disposed substantially centrally between them are advantageously inclined. Particularly, the intermediate guide rollers are cantably oriented to rotate in a pair of symmetrically angularly related vertical planes 72 and 74 which diverge in the forward direction at an angle of 3° to the normal longitudinal direction of vehicle travel as diagrammatically illustrated in FIG. 3 by the angle identified by the reference letter A. Thus, in certain modes of operation, to be hereinafter described, the canted guide rollers 68 serve to transfer side loads as well as longitudinal loads from the carriage assembly 24 corneringly into the channular beams 41 of the inner upright 32.

In order to further transfer side loads, however, the legs 50 of the carriage assembly 24 are each provided with a window 76 transversely therethrough and disposed elevationally closely below the upper carriage guide rollers 66. As best shown in FIG. 5, a pair of capscrews 78 are adapted to be screw threadably received in the laterally outwardly facing surface of each leg on either side of the windows for securing a longitudinally oriented and appropriately shimmed stepped mounting pin 80 thereto. An upper side thrust roller 82 is rotatably mounted on each of these pins for selective engagement with the laterally inner web surfaces 42 of the channular beams 41.

In addition to the upper side thrust rollers 82, the carriage assembly 24 includes a pair of lower side thrust rollers 84 which are mounted on longitudinally oriented pivot joints 86 secured in a rearwardly extending manner from the lower back-up plate 52. These lower side thrust rollers are adapted to bear perpendicularly against the front portion of the laterally outer sides of the beams 41. Moreover, a pair of laterally spaced chain anchor pin joints 88 are also secured to the rear of the lower back-up plate between the legs 50.

In order to elevate the carriage assembly 24 and inner upright 32 to the desired position, the extendable lifting apparatus 28 is secured to the base 36 of the stationary upright 30 as may be visualized with reference to FIG. 3. As is also shown in FIGS. 1 and 2, the lifting apparatus includes a hydraulically actuated lift cylinder 90 with a vertically extemdable cross head 92 disposed on the upper extremity thereof. A pair of anti-friction bearing mounted chain rollers 94 are mounted on the opposite sides of the cross head and a pair of chains 96 are looped over them. The rearwardly disposed and depending ends of the chains, not shown, are suitably secured to the stationary upright in a conventional manner, while the forwardly disposed and opposite ends of the chains extend downwardly where they are secured to the carriage assembly 24 at the anchor pin joints 88.

Thus, the initial extension of the lift cylinder 90 will cause the cross head 92 and the chain rollers 94 to be elevated to raise only the carriage assembly 24 including the lift forks 22 and load carried thereby above the ground. Since the stationary upright 30 and the inner upright 32 are not initially raised, the overall height of the lift truck 10 is maintained at an advantageously low value to enable it to go through doorways, for example.

However, upon upward extension of the cross head 92 the "free lift" distance identified by the reference letter B in FIG. 1, it makes abutting contact with the cantilevered arm 46 and further raising thereof will result in upward travel of the inner upright 32 also. In the embodiment illustrated, the carriage assembly 25 is raised relatively more rapidly than the inner upright to thereafter allow a load carried by the forks 22 to be deposited on a shelf, truck bed or the like.

OPERATION

While the construction and operation of the present invention is believed clearly apparent from the foregoing description, further amplification will subsequently be made in the following brief summary of the operation thereof. When the carriage upper guide rollers 66 and lower guide rollers 70 are elevationally disposed within the channular beams 41 of the inner upright 32, and with the forks 22 carrying a load, they respectively make rolling engagement with the front rail surfaces 43 and rear rail surfaces 44 of their associated channular beams in planes substantially perpendicular thereto as may be best visualized with reference to FIG. 3. Under these conditions the canted guide rollers 68 do not normally make rolling contact with the beams. This can also be appreciated by making reference to FIG. 2 and assuming that the upper guide rollers are elevationally lowered from the position shown to engage the beams, and that an offset load is acting on the forks which tends to rotate the carriage assembly 24 in a clockwise direction when viewing the drawing. In this circumstance, the lower right side thrust roller 84 transmits loads to the laterally outer side surface of the right beam 41. At the same time the upper right window side thrust roller 82 transmits loads to the laterally inner web surface 42 of the right beam. Thus, in accordance with one aspect of the invention, the clockwise-acting load results in a lateral resisting reaction on a single one of the channular beams so that spreading thereof is minimized. It is to be appreciated that the guide rollers 66 and 70 are desirably relieved from transmitting side loads under these conditions.

Pursuant to the present invention, provision is made to fully utilize the load transferring and guiding function of the canted guide rollers 68 upon extending the forks 22 to a substantially fully raised condition. Such condition is illustrated in FIG. 2, wherein it is clear that the upper guide rollers 66 and the window side thrust rollers 82 are extended upwardly beyond the beams 41. While this desirably permits maximum elevation of the carriage assembly 24, it is clearly apparent that the canted guide rollers must subsequently assume the dual function of transferring longitudinal and lateral stabilizing loads at the top of the channular beams. Note is also made that the canted guide rollers extend to within an extremely limited distance "H" from the top of the beams.

Specifically, if it is again assumed that a clockwise load is applied to the carriage assembly 24, a reaction is transmitted by the lower right side thrust roller 84 against the laterally outer surface of the right beam 41 when viewing FIG. 2. On the upper portion of the carriage assembly the lateral reaction is transmitted by the upper right canted guide roller 68 corneringly against the web surface 42 of the right beam. Again, the side thrust reaction is desirably on only one of the beams, which tends to reduce distortion of the oppositely associated rolling surfaces.

The canted guide rollers 68 also transmit longitudinal forces under the aforementioned FIG. 2 conditions by bearing corneringly against the front rail surfaces 43 of the beams 41, while the lower guide rollers 70 bear rearwardly and perpendicularly against the rear rail surfaces 44 of the beams. Advantageously, the canted guide rollers 68 exhibit a substantial vertical moment arm or spacing elevationally above the lower guide rollers since they are located above the mid-plane 71. This improves the transfer of forces upon the supporting beams and increases the service life of the mast carriage mounting arrangement 20.

While the canted guide rollers 68 may be positioned just below the upper extremity of the beams 41 for maximum elevational extension of the carriage assembly 24, it is to be appreciated that upon initial lowering thereof the window side thrust rollers 82 will engage the beams to relieve any side thrust loading on the canted guide rollers. Moreover, upon further lowering of the upper guide rollers 66 into the beams, the canted guide rollers are substantially isolated from longitudinal loads as well.

In view of the foregoing, it is readily apparent that the lift mast carriage mounting arrangement 20 of the present invention provides a carriage assembly with six guide rollers and four side thrust rollers thereon for selective optimum rolling engagement against the guiding channular beams. The intermediately disposed and canted guide rollers 68 progressively assume the job of transferring longitudinal loads when the upper guide rollers 66 extend upwardly beyond the beams, and then the additional job of transferring lateral loads when the window side thrust rollers 82 extend beyond them. On the other hand, when the carriage assembly is not so extended, the upper guide rollers 66 and the lower guide rollers 70 do not have such a dual responsibility and so solely make perpendicular contact with the rail surfaces 43 and 44 of the beams. In the latter case the side thrust rollers 82 and the side thrust rollers 84 also solely make lateral rolling contact with the beams to provide an extended service life thereof. Because these rollers transmit forces substantially only normal to their axes the bearing life thereof is effectively extended and the degree of beam flaking is substantially reduced.

While the invention has been described and shown with particular reference to a preferred embodiment, it will be apparent that variations might be possible that would fall within the scope of the present invention, which is not intended to be limited except as defined in the following claims.

What is claimed is:

1. In a lift mast carriage mounting arrangement of the type including a support assembly having an upright pair of laterally spaced and inwardly facing channular beams, each beam having a pair of rail surfaces and an interconnecting web surface, the rail surfaces being substantially normal to the respective web surface; a carriage assembly having an upright pair of elongated legs, an upper pair of guide rollers, a lower pair of guide rollers, an upper pair of side thrust rollers, and a lower pair of side thrust rollers, the legs being disposed for movement between and longitudinally along the channular beams on the rollers, the upper and lower pairs of guide rollers individually having rolling planes longitudinally oriented and substantially normal to the rail surfaces; wherein the improvement comprises:

means for coupling with said lower pair of side thrust rollers for transmitting side thrust forces from the carriage assembly to said channular beams only when said upper guide rollers and said upper side thrust rolllers are elevationally disposed beyond said channular beams, said means including a pair of canted guide rollers mounted on said legs elevationally intermediate said upper and lower pairs of guide rollers and individually having a rolling plane angularly oriented relative to said rail surfaces and said web surfaces, said canted guide rollers being substantially free of force transmitting contact with said channular beams when said upper guide rollers are elevationally disposed within said channular beams said rolling planes of said canted guide rollers being angularly inclined at least about three degrees relative to said rolling planes of said upper and lower pairs of guide rollers.

2. The lift mast carriage mounting arrangement of claim 1 wherein said legs support said upper pair of side thrust rollers elevationally between said upper guide rollers and said canted guide rollers, said upper pair of side thrust rollers being of a construction sufficient for rolling engagement laterally outwardly against said channular beams.

3. The lift mast carriage mounting arrangement of claim 1 wherein said carriage assembly, said canted guide rollers and said lower side thrust rollers are of a construction sufficient for transmitting side thrust forces against a single one of said channular beams.

* * * * *